US011346360B2

(12) United States Patent
Mason et al.

(10) Patent No.: US 11,346,360 B2
(45) Date of Patent: May 31, 2022

(54) CEILING FAN WITH MOUNTING ASSEMBLY

(71) Applicant: Hunter Fan Company, Memphis, TN (US)

(72) Inventors: Douglas Troy Mason, Horn Lake, MS (US); Bobby Neal Norwood, Oakland, TN (US); Matthew McPherson, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 179 days.

(21) Appl. No.: 16/738,002

(22) Filed: Jan. 9, 2020

(65) Prior Publication Data

US 2021/0215167 A1 Jul. 15, 2021

(51) Int. Cl.

| | |
|---|---|
| ***F04D 29/32*** | (2006.01) |
| ***F04D 29/26*** | (2006.01) |
| ***F04D 25/06*** | (2006.01) |
| ***F04D 25/08*** | (2006.01) |

(52) U.S. Cl.

CPC ..... *F04D 29/325* (2013.01); *F04D 25/06* (2013.01); *F04D 25/088* (2013.01); *F04D 29/263* (2013.01)

(58) Field of Classification Search

CPC ..... F04D 29/325; F16M 13/027; F16M 11/2078; F21V 21/02

See application file for complete search history.

(56) References Cited

U.S. PATENT DOCUMENTS

| | | | | |
|---|---|---|---|---|
| 2,907,545 | A * | 10/1959 | Beck | F21V 21/03 248/343 |
| 6,139,279 | A | 10/2000 | Pearce et al. | |
| 7,080,813 | B1 | 7/2006 | Frampton et al. | |
| 2009/0230274 | A1 * | 9/2009 | Tang | F04D 29/60 248/343 |
| 2011/0052411 | A1 | 3/2011 | Yamamoto et al. | |

FOREIGN PATENT DOCUMENTS

| | | |
|---|---|---|
| CN | 206582177 U | 10/2017 |

* cited by examiner

*Primary Examiner* — Kenneth J Hansen
(74) *Attorney, Agent, or Firm* — McGarry Bair PC

(57) ABSTRACT

A ceiling fan assembly or similar air-moving device can include a motor for rotating one or more blades to drive a volume of air about a space. The ceiling fan assembly can include a ceiling fan mount with a dual axis gimble. The dual axis gimble can be received by a mounting bracket so that at least a first and second axis of rotation are provided to the ceiling fan assembly.

20 Claims, 5 Drawing Sheets

CEILING FAN WITH MOUNTING ASSEMBLY

BACKGROUND

Ceiling fans are machines typically suspended from a structure for moving a volume of air about an area. While the structure to which the ceiling fan is mounted is typically a ceiling or part of a ceiling, such as a joist or beam, the structure can be a wall or any other structure for that matter.

The ceiling fan includes a motor, with a rotor and stator, suspended from and electrically coupled to the structure. A set of blades mount to the rotor such that the blades are rotatably driven by the rotor and can be provided at an angled orientation to move a volume of air about the area.

A common ceiling mount is a ball-and-socket or ball mount has the advantage of permitting the ceiling fan to pivot relative to the ceiling in response to a reaction force from the rotating blades. A disadvantage of the ball mount is that if the ball is not rotationally constrained, the ceiling fan can precess about the rotational axis, which can interfere with wires and the like that extend through the ceiling and into the ceiling fan via the mount. Ball mounts are, thus, typically rotational constrained to prevent precession, which limits the ball amount to one degree of rotational freedom.

BRIEF DESCRIPTION

In one aspect, the disclosure relates to a ceiling fan assembly that includes a motor having a rotor and a stator, at least one fan blade operably coupled to the rotor, a downrod having first and second ends, with the first end coupled to the motor, a mounting bracket, and at least a dual axis gimble connecting the second end of the downrod to the mounting bracket.

In another aspect, the disclosure relates to a ceiling fan mount for connecting a ceiling fan to a surface that includes a downrod having first and second ends, with the first end configured to couple to the ceiling fan, a mounting bracket configured to mount to the surface, and at least a dual axis gimble connecting the second end of the downrod to the mounting bracket.

DETAILED DESCRIPTION

Figure 1:
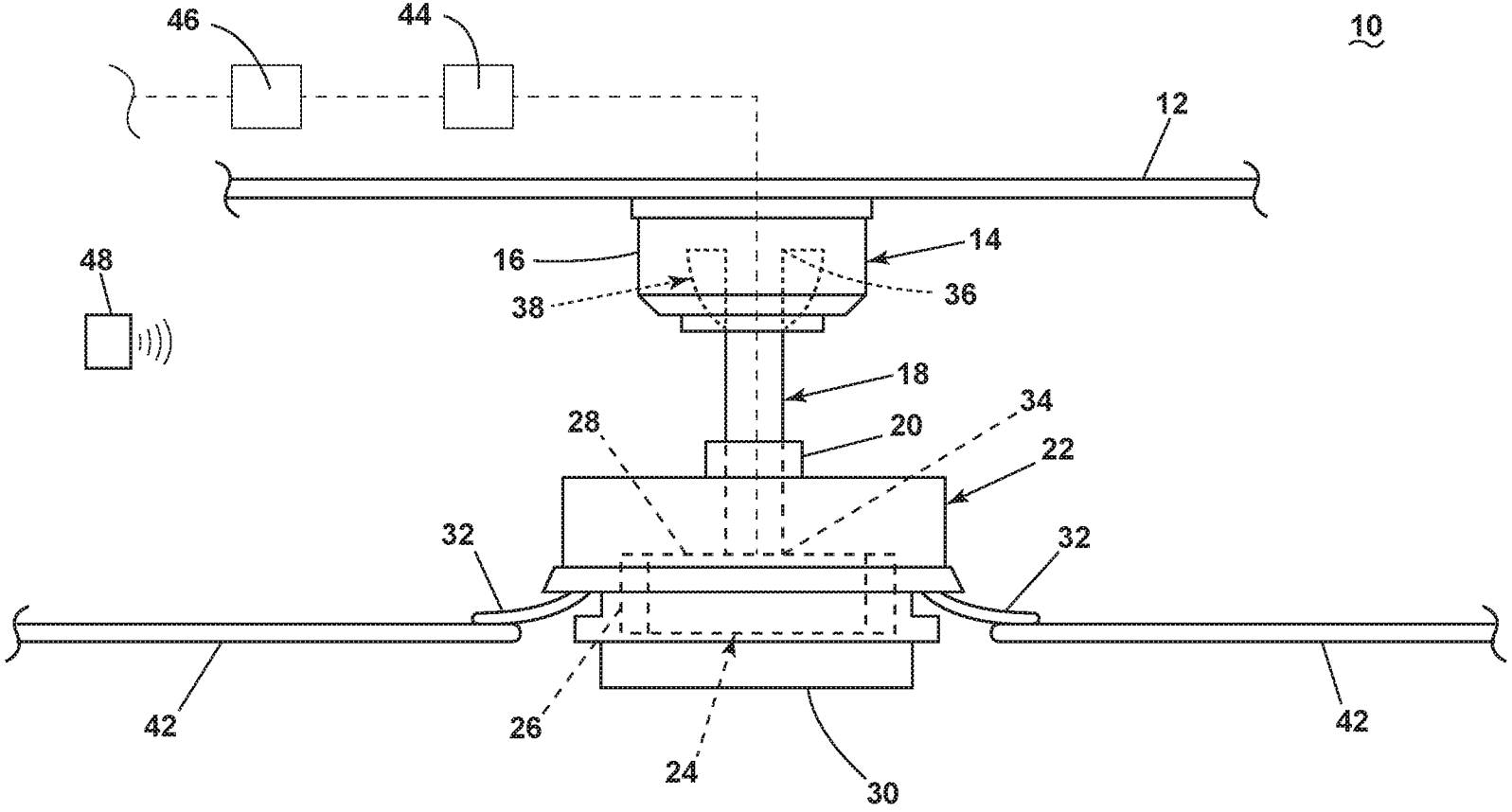
FIG. 1 is a schematic view of a structure with a ceiling fan assembly suspended from a structure and including a ceiling fan mount.

The disclosure is related to a ceiling fan and ceiling fan blade, which can be used, for example, in residential and commercial applications. Such applications can be indoors, outdoors, or both. While this description is primarily directed toward a residential ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan assembly 10 is suspended from a structure 12. In non-limiting examples, the ceiling fan assembly 10 can include one or more ceiling fan components including a ceiling fan mount 14 with a downrod 18, a canopy 16, a motor adapter 20, a motor housing 22 at least partially encasing a motor 24 having a rotor 26 and a stator 28, a light kit 30, a set of blade irons 32, and a set of blades 42. In additional non-limiting examples, the ceiling fan assembly 10 can include one or more of a controller, a wireless receiver, a light glass, a light cage, a spindle, a finial, a switch housing, blade forks, blade tips or blade caps, or other ceiling fan components.

The downrod 18 can have a first end 34 and second end 36. The first end 34 of the downrod 18 can be coupled to the motor 24. Alternatively, the first end 34 of the downrod 18 can be configured to couple to at least one component of a ceiling fan. The second end 36 of the downrod 18 can be coupled to at least a dual axis gimble. While the at least dual axis gimble illustrated as a dual axis gimble 38, it is contemplated that the at least dual axis gimble can be a three axis gimble. The dual axis gimble 38 is a pivoted support that allows the rotation of an object about a two axes, providing at least two degrees of rotational freedom.

At least one fan blade 42 can be carried by the rotor 26. For example, the at least one fan blade 42 can extend radially from the ceiling fan assembly 10, and can be rotatable to drive a volume of fluid such as air. That is, the at least one fan blade 42 can be operably coupled to the motor 24 at the rotor 26, such as via the blade irons 32. The at least one fan blade 42 can include a set of blades 42, having any number of blades, including only one blade.

The structure 12 can be a ceiling, for example, from which the ceiling fan assembly 10 is suspended. It should be understood that the structure 12 is schematically shown and is by way of example only, and can include any suitable building, structure, home, business, or other environment wherein moving air with a ceiling fan is suitable or desirable. The structure 12 can also include an electrical supply 44 and can electrically couple to the ceiling fan assembly 10 to provide electrical power to the ceiling fan assembly 10 and the motor 24 therein. It is also contemplated that the electrical supply be sourced from somewhere other than the structure 12, such as a battery or generator in non-limiting examples.

A controller 46 can be electrically coupled to the electrical supply 44 to control operation of the ceiling fan assembly 10 via the electrical supply 44. Alternatively, the controller 46 can be wirelessly or communicatively coupled to the ceiling fan assembly 10, configured to control operation of the ceiling fan assembly 10 remotely, without a dedicated connection. Non-limiting examples of controls for the ceiling fan assembly 10 can include fan speed, fan direction, or light operation. Furthermore, a separate wireless controller 48, alone or in addition to the wired controller 46, can be communicatively coupled to a controller or a wireless receiver in the ceiling fan assembly 10 to control operation of the ceiling fan assembly 10. It is further contemplated in one alternative example that the ceiling fan be operated by the wireless controller 48 alone, and is not operably coupled with the wired controller 46.

Figure 2:
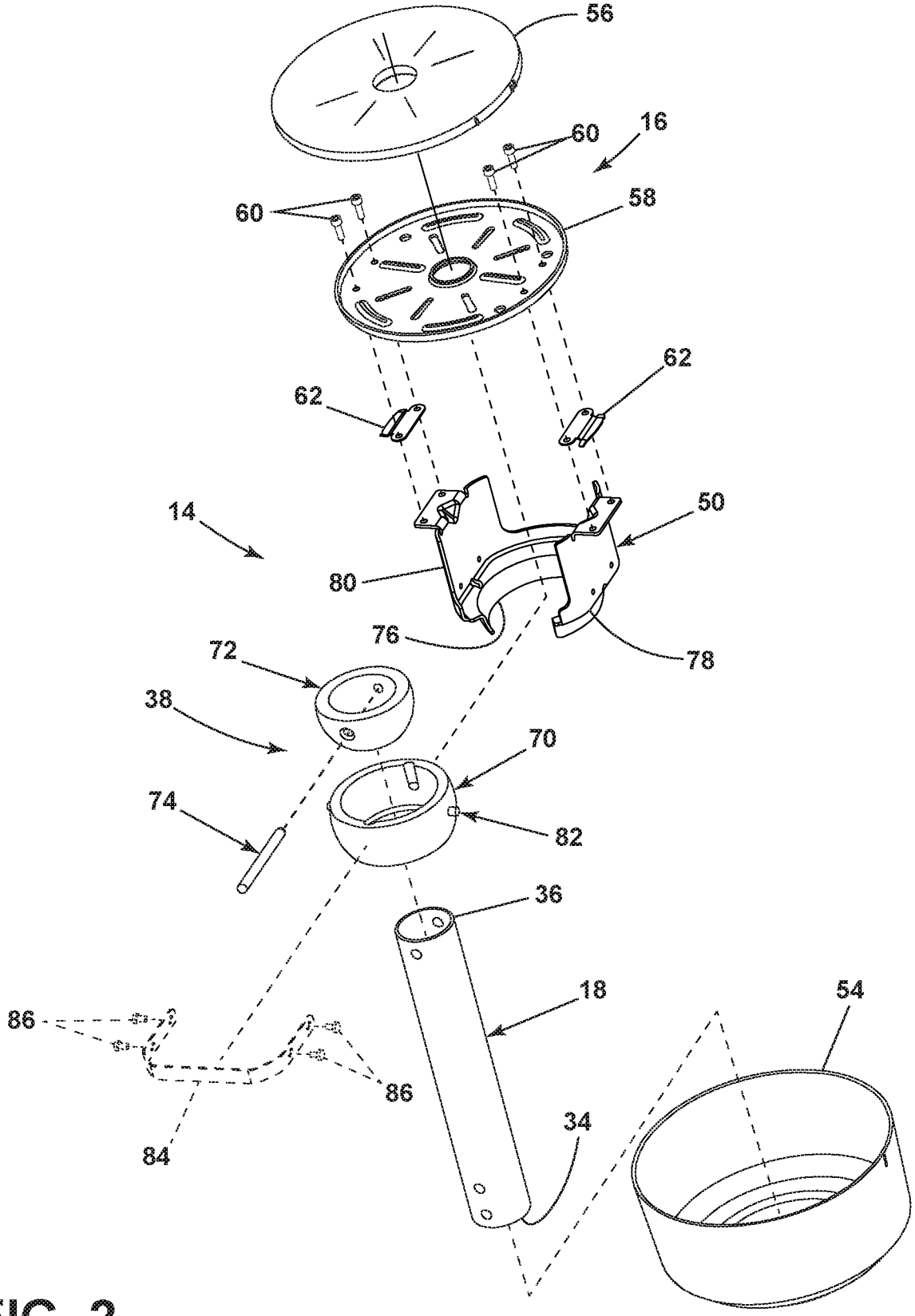
FIG. 2 is an exploded view of the ceiling fan mount of FIG. 1 illustrating a dual axis gimble.

Referring to FIG. 2, the ceiling fan mount 14 and the canopy 16 are illustrated in an exploded view. The ceiling fan mount 14 can include the downrod 18, the dual axis gimble 38, and a mounting bracket 50. The ceiling fan mount 14 can couple to or further include the canopy 16. The canopy 16 can be a decorative cover to encase or hide at least a portion of the ceiling fan mount 14. The canopy 16 can include a shell portion 54 that can secure to a first plate 56 or a second plate 58. The second plate 58 can fasten to the mounting bracket 50. By way of non-limiting example, casing fasteners 60 and casing fastener plates 62 can couple the second plate 58 to the mounting bracket 50. The second plate 58 can couple to the first plate 56, which can abut the structure 12, therefore configuring the mounting bracket 50 to mount to the structure 12. The shell portion 54 of the canopy 16 can slidalby receive the downrod 18. When positioned, the shell portion 54 can circumscribe the mounting bracket 50 and can fasten to at least the second plate 58.

The dual axis gimble 38 is illustrated, by way of example, as having a ball-in-a-ball structure, however, all dual axis gimble structures are contemplated. The dual axis gimble 38 can include an outer hanger ball or first hanger ball 70 and an inner hanger ball or second hanger ball 72. A second shaft 74 can pivotally couple the second hanger ball 72 to the second end 36 of the downrod 18.

The mounting bracket 50 can include a seat 76 supported by a collar 78. The collar 78 can receive the dual axis gimble 38 via a side opening 80. A first shaft 82 can pivotally couple the first hanger ball 70 of the dual axis gimble 38 to the mounting bracket 50.

Optionally, a fixing bar 84 can be secured to the mounting bracket 50 once the dual axis gimble 38 is seated in the seat 76 of the mounting bracket 50. The fixing bar 84 can be secured with fasteners 86.

Figure 3:
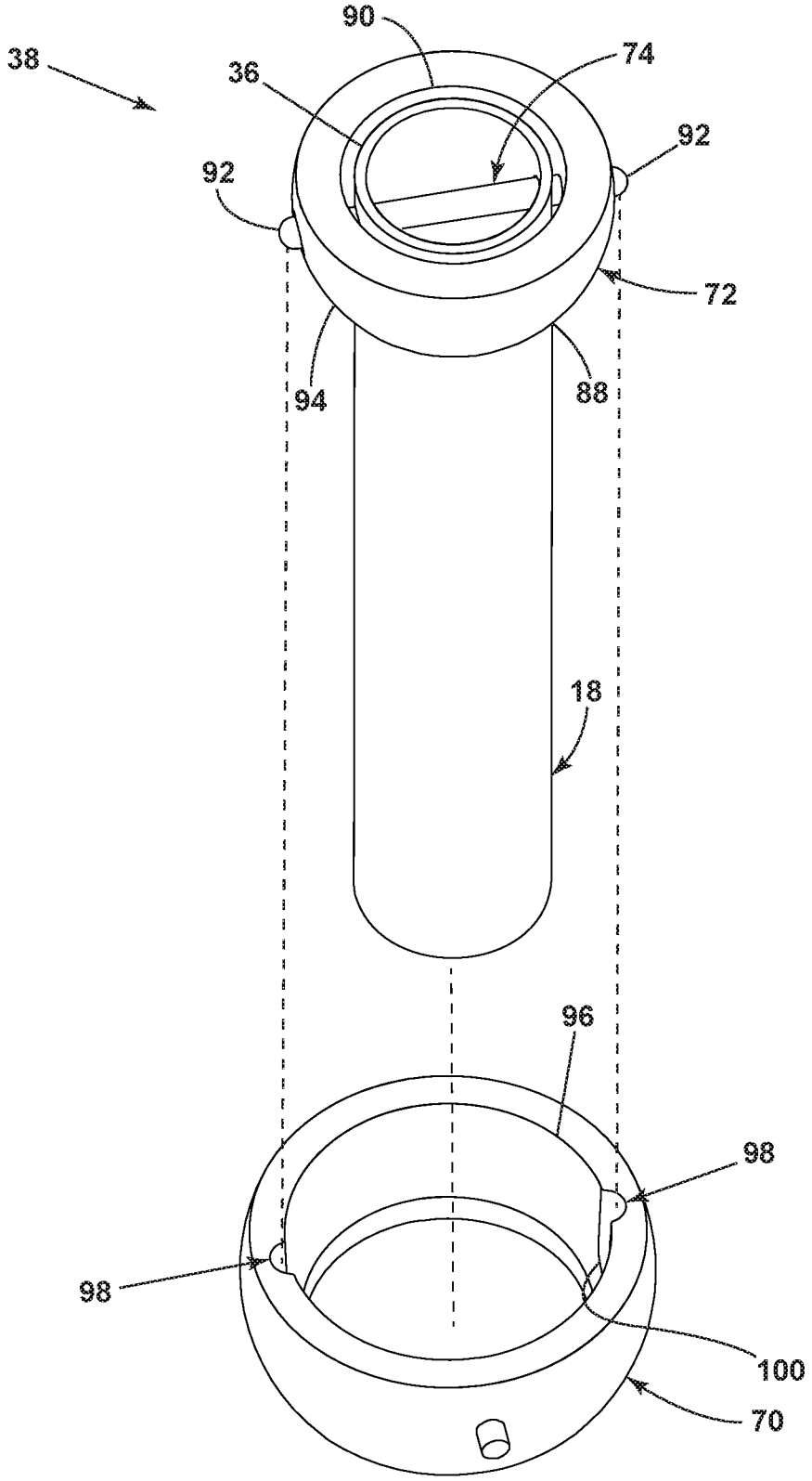
FIG. 3 is a partially exploded perspective view of the dual axis gimble and a downrod of FIG. 2.

FIG. 3 further illustrates the downrod 18 coupled to the second hanger ball 72 of the dual axis gimble 38. A downrod passage 88 formed in the second hanger ball 72 receives the second end 36 of the downrod 18 into an interior portion 90 of the second hanger ball 72. The downrod 18 extends into the interior portion 90 until the second shaft 74 can pass through the second end 36 of the downrod 18 and the second hanger ball 72. That is, the second shaft 74 passes through the second end 36 of the downrod 18 to operably connect the downrod 18 to the dual axis gimble 38. Opposing ends 92 of the second shaft 74 can extend beyond an exterior portion 94 of the second hanger ball 72. That is, the opposing ends 92 extend externally from the second hanger ball 72.

An interior wall 96 of the first hanger ball 70 can include at least one recess, illustrated, by way of non-limiting example, as grooves 98. At least a portion of the grooves 98 can include corresponding supports 100 for the opposing ends 92 of the second shaft 74. That is, the second shaft 74 rotatably connects the second hanger ball 72 to the first hanger ball 70 when the opposing ends 92 of the second shaft 74 are located in the corresponding supports 100 in the grooves 98 of the first hanger ball 70, further illustrated in FIG. 4.

It is a matter of convenience that the opposing ends 92 of the second shaft 74 are used to mount the downrod 18 to the second hanger ball 72 while simultaneously providing nubs forming the opposing ends 92 to be received within the grooves 98 of the first hanger ball 70. It is contemplated that the second end 36 of the downrod 18 can fasten or otherwise couple to the first hanger ball 70 in a variety of ways. By way of non-limiting example, pins, nubs, or protrusions from the first or second hanger ball, 70, 72 could extend into the downrod 18. The pins, nubs, or protrusions need not be aligned with, formed by, or coupled to the second shaft 74.

While the coupling of the first and second hanger balls 70, 72 is disclosed as the seating of opposing ends 92 in the corresponding supports 100, it is contemplated that the first and second hanger balls 70, 72 can be coupled using any known technique. By way of non-limiting example, pins, nubs, or protrusions from the first hanger ball 70 can extend into a recess or receiving portion of the second hanger ball 72.

Figure 4:
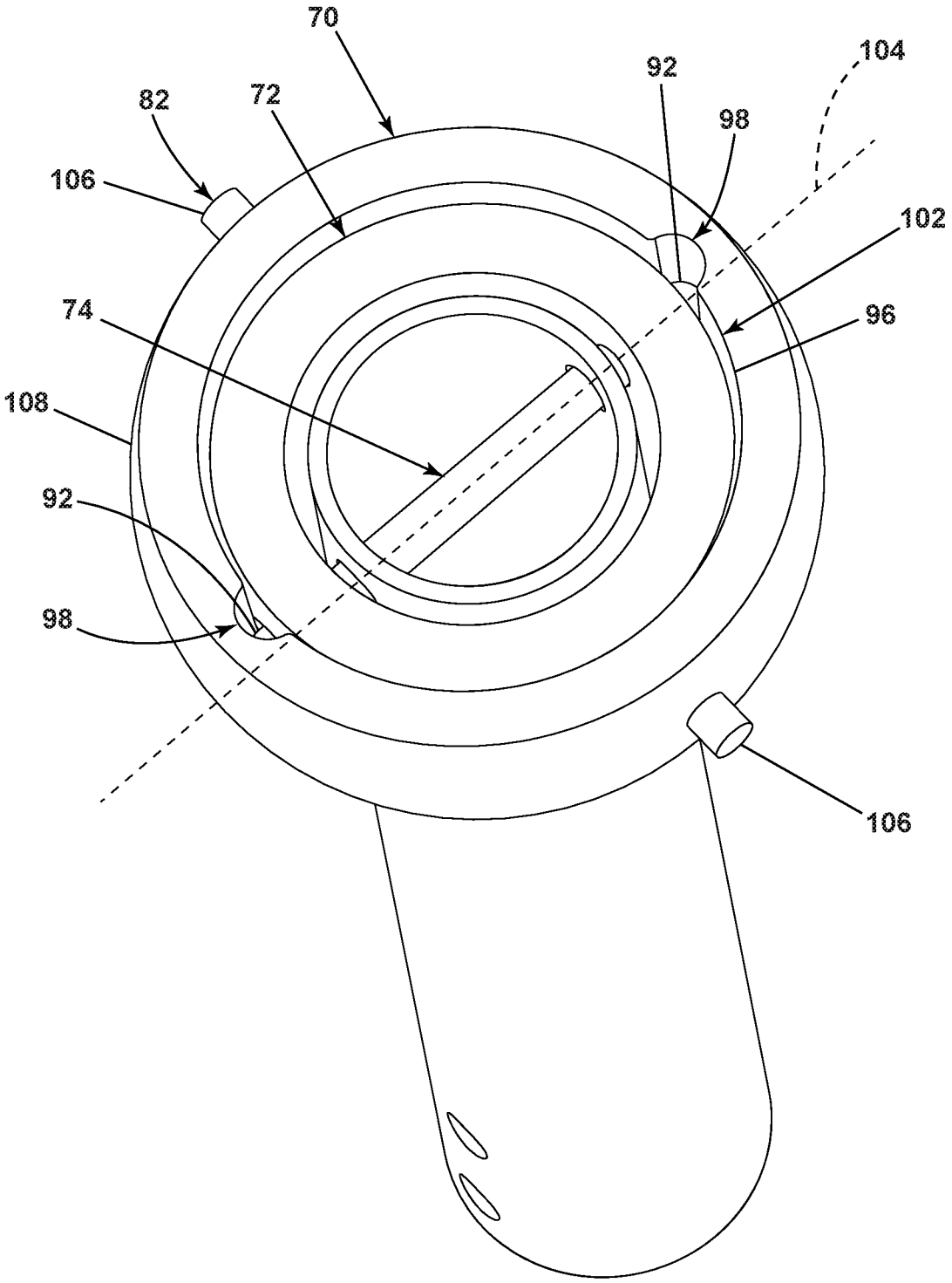
FIG. 4 is an assembled perspective view of the dual axis gimble of FIG. 3 and the downrod.

Referring to FIG. 4, when the second hanger ball 72 is rotatably connected to the first hanger ball 70, the second hanger ball 72 is located with an interior 102 of the first hanger ball 70 defined by the interior wall 96. That is, the first hanger ball 70 circumscribes the second hanger ball 72 when the dual axis gimble 38 is assembled.

An inner rotational axis 104 is defined by the rotatable connection of the first and second hanger balls 70, 72. That is, the inner rotational axis 104, as illustrated by way of example, can be formed by the second shaft 74.

As illustrated, by way of non-limiting example, opposing ends of the first shaft 82 of the first hanger ball 70 can include two pins 106 that extend from an exterior 108 of the first hanger ball 70. The two pins 106 can extend from diametrically opposite portions of the first hanger ball 70.

Figure 5:
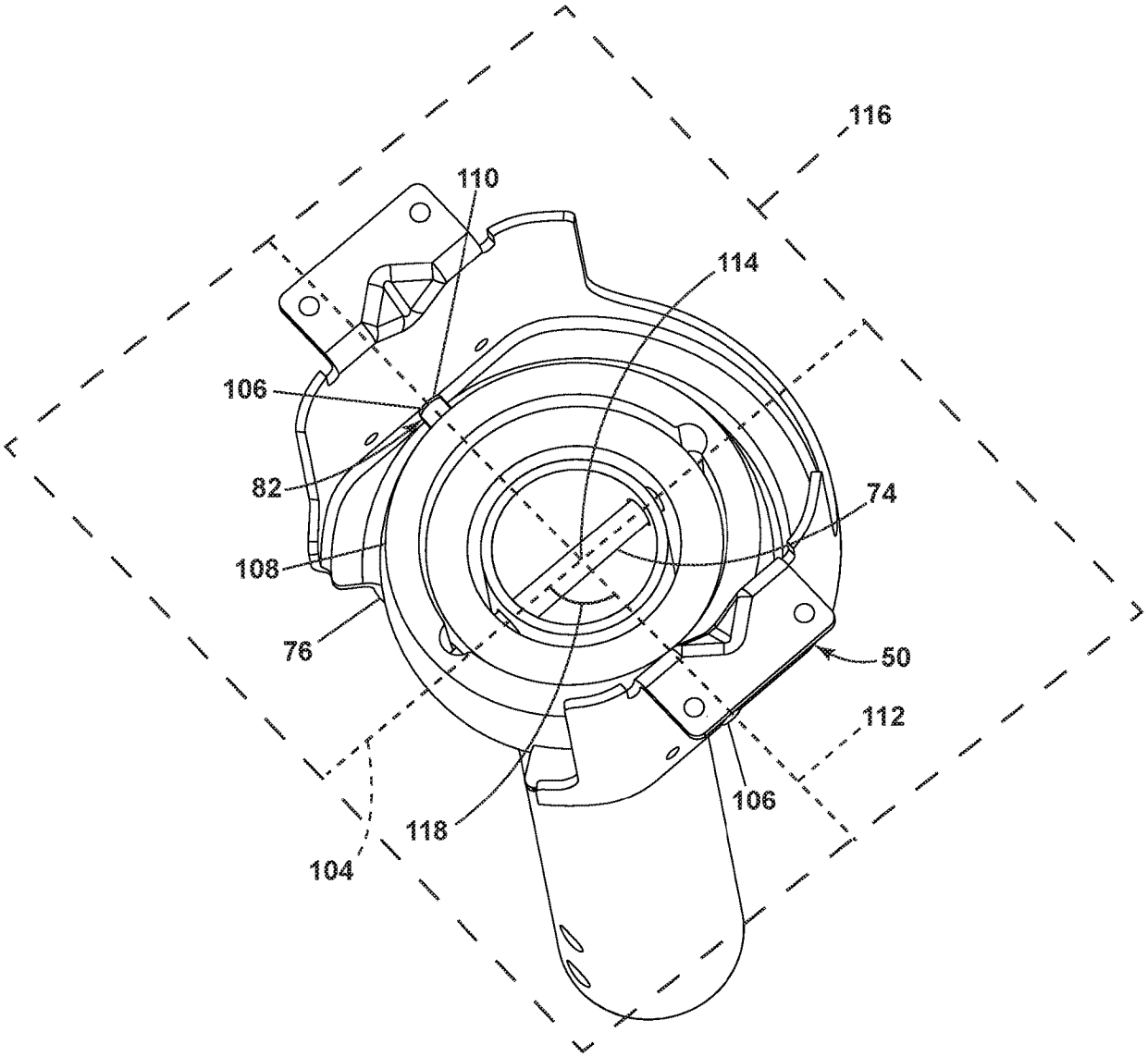
FIG. 5 is a perspective view of the assembled dual axis gimble of FIG. 4 seated in a mounting bracket.

FIG. 5 further illustrates the dual axis gimble 38 located in the seat 76 of the mounting bracket 50. A first shaft 82 rotatably connects the dual axis gimble 38 to the mounting bracket 50.

Supports 110 in the mounting bracket 50 can receive the two pins 106 of the first shaft 82. The first hanger ball 70 of the dual axis gimble 38 is located in the seat 76 of the mounting bracket 50 when the two pins 106 are located in the supports 110. Therefore, the first hanger ball 70 is rotationally mounted to the mounting bracket 50 via the first shaft 82.

An external rotational axis 112 is defined by the rotatable connection of the first hanger ball 70 and the mounting bracket 50. That is, the external rotational axis 112, as illustrated by way of example, can be formed by the two pins 106.

The external rotational axis 112 and the inner rotational axis 104 provide a first and second rotational axes for the dual axis gimble 38. As illustrated, by way of non-limiting example, the external rotational axis 112 and the inner rotational axis 104 can be in a same plane 116. That is, the plane 116 can be defined by the external rotational axis 112 and the inner rotational axis 104.

Further illustrated, by way of non-limiting example, the external rotational axis 112 and the inner rotational axis 104 cross or intersect at a point 114. The point 114 can be located at the geometric center or the center of mass of the second shaft 74 in the plane 116. An angle 118 measured between the external rotational axis 112 and the inner rotational axis 104 can be 90 degrees, however other angles are contemplated.

A non-limiting example of assembly of the ceiling fan mount 14 and canopy 16 can begin with the second plate 58 coupled to the mounting bracket 50 via the casing fasteners 60 and the casing fastener plates 62. The first plate 56 can then be coupled to the second plate 58.

The second end 36 of the downrod 18 slides through the downrod passage 88 in the second hanger ball 72. The second end 36 of the downrod 18 protrudes into the interior portion 90 of the second hanger ball 72 until the second shaft 74 can extend or pass through the second hanger ball 72 and the second end 36 of the downrod 18. The second shaft 74 has opposing ends 92 that protrude from the exterior portion 94 of the second hanger ball 72. The opposing ends 92 of the second shaft 74 can enter the grooves 98 of the first hanger ball 70. Once the opposing ends 92 of the second shaft 74 are located in the corresponding supports 100, the first and second hanger balls 70, 72 are rotatably connected by the second shaft 74. The second shaft 74 forms the inner rotational axis 104 of the dual axis gimble 38.

The dual axis gimble 38 enters the mounting bracket 50 through the side opening 80 of the collar 78. The dual axis gimble 38, once inside the mounting bracket 50 is properly positioned or seated by the reception of the two pins 106 extending from the first hanger ball 70 by the supports 110 of the mounting bracket 50. That is, when the first hanger ball 70 is located in the seat 76, the first hanger ball 70 is rotatably connected to the mounting bracket 50 via the first shaft 82. The seating of the dual axis gimble 38 in the seat 76 provides a connection between the second end 36 of the downrod 18 and the mounting bracket 50. The first shaft 82 can define the external rotational axis 112 of the dual axis gimble 38.

Optionally, the fixing bar 84 can be coupled to the mounting bracket 50 once the dual axis gimble 38 is seated. The fasteners 86 can be used to fasten the fixing bar 84 to the mounting bracket 50. The fixing bar 84 can encourage the dual axis gimble 38 to remain properly positioned in the seat 76.

The shell portion 54 can then be placed on the first end 34 of the downrod 18 so that the shell portion 54 circumscribes the downrod 18. The shell portion 54 can then slide on the downrod 18 towards the first or second plates 56, 58. Once fastened, the shell portion 54 will encase the mounting bracket 50.

In operation, the assembled ceiling fan mount 14 with the canopy 16 can be coupled to the structure 12. The dual axis gimble 38 can rotate on the first and second shafts 74, 82 that define the inner rotational axis 104 and the external rotational axis 112. Rotation about the inner and external rotational axes 104, 112 can adjust the downrod 18 so that the ceiling fan assembly 10 remains level regardless of the structure 12 to which it is mounted. The inner and external rotational axis 104, 112 provide two degrees of rotational freedom. This gives increases the flexibility in mounting the ceiling fan assembly 10, while preventing precession of the ceiling fan assembly 10.

Benefits of aspects of the present disclosure include a providing at least two rotational axes about which the ceiling fan assembly can pivot when coupled to the surface.

Further, the at least dual axis gimble, when positioned in the seat, can help limit the movement of the downrod and motor housing, especially during operation. This is beneficial as, when in operation, inertia of the rotating blades can otherwise cause an unbalance or unwanted movement of the ceiling fan if too much rotation is allowing the ceiling fan mount.

Another benefit of the disclosure includes a reduction or elimination of reactionary forces when the inner and external rotational axes are located in the same plane with the point of intersection at the center of the second shaft. Reactionary forces are generated when a fan is running and supported by a mount that allows two-dimensional rotation where the axes of the two-dimensional rotation are not in the same plane. Reactionary forces can cause the fan to tilt when running.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the invention are provided by the subject matter of the following clauses:

1. A ceiling fan assembly that include a motor having a rotor and a stator, at least one fan blade operably coupled to the rotor, a downrod having first and second ends, with the first end coupled to the motor, a mounting bracket, and at least a dual axis gimble connecting the second end of the downrod to the mounting bracket.

2. The ceiling fan assembly of clause 1 where the mounting bracket comprises a seat and the dual axis gimble is located in the seat.

3. The ceiling fan assembly of any preceding clause wherein the dual axis gimble comprises a first hanger ball located in the seat.

4. The ceiling fan assembly of any preceding clause wherein the first hanger ball includes a first shaft rotationally connecting the first hanger ball to the mounting bracket to define a first rotational axis for the dual axis gimble.

5. The ceiling fan assembly of any preceding clause wherein the first shaft comprises two pins extending from diametrically opposite portions of the first hanger ball.

6. The ceiling fan assembly of any preceding clause wherein the dual axis gimble further comprises a second hanger ball located with an interior of the first hanger ball.

7. The ceiling fan assembly of any preceding clause wherein the second hanger ball is rotationally coupled to the first hanger ball to define a second rotational axis for the dual axis gimble.

8. The ceiling fan assembly of any preceding clause wherein the second hanger ball comprises a second shaft rotationally connecting the second hanger ball to the first hanger ball, with the second shaft forming the second rotational axis.

9. The ceiling fan assembly of any preceding clause wherein the second shaft passes through the second end of the downrod to operably connect the downrod to the dual axis gimble.

10. The ceiling fan assembly of any preceding clause wherein the second shaft passes through the second hanger ball.

11. The ceiling fan assembly of any preceding clause wherein the second shaft has opposing ends extending externally of the second hanger ball, and the opposing ends are rotationally supported by corresponding supports in the first hanger ball.

12. The ceiling fan assembly of any preceding clause wherein the second hanger ball comprises a downrod passage in which the second end of the downrod is received.

13. The ceiling fan assembly of any preceding clause wherein the mounting bracket comprises a collar supporting the seat and the collar has a side opening through which the first hanger ball is received.

14. The ceiling fan assembly of any preceding clause wherein the mounting bracket includes supports in which opposing ends of the first shaft are rotationally supported.

15. A ceiling fan mount for connecting a ceiling fan to a surface that includes a downrod having first and second ends, with the first end configured to couple to the ceiling fan, a mounting bracket configured to mount to the surface, and at least a dual axis gimble connecting the second end of the downrod to the mounting bracket.

16. The ceiling fan mount of any preceding clause wherein the mounting bracket comprises a seat and the dual axis gimble is received in the seat.

17. The ceiling fan mount of any preceding clause wherein the dual axis gimble comprises an inner hanger ball rotatably mounted to an outer hanger ball, which is rotatably mounted to the mounting bracket.

18. The ceiling fan mount of any preceding clause wherein the second end of the downrod is mounted to the inner hanger ball.

19. The ceiling fan mount of any preceding clause further comprising a first shaft rotationally mounting the outer hanger ball to the mounting bracket.

20. The ceiling fan mount of any preceding clause further comprising a second shaft mounting the second end of the downrod to the inner hanger ball and rotationally mounting the inner hanger ball to the outer hanger ball.

What is claimed is:

1. A ceiling fan assembly comprising:

a motor having a rotor and a stator;

at least one fan blade operably coupled to the rotor;

a downrod having first and second ends, with the first end coupled to the motor;

a mounting bracket; and at least a dual axis gimble connecting the second end of the downrod to the mounting bracket, wherein the dual axis gimble comprises:

a first hanger ball comprising a first shaft rotationally connecting the first hanger ball to the mounting bracket to define a first rotational axis for the dual axis gimble; and a second hanger ball, located within an interior of the first hanger ball, the second hanger ball comprising a second shaft rotationally connecting the second hanger ball to the first hanger ball, with the second shaft defining a second rotational axis.

2. The ceiling fan assembly of claim 1 where the mounting bracket comprises a seat and the dual axis gimble is located in the seat.

3. The ceiling fan assembly of claim 2 wherein the first hanger ball of the dual axis gimble is located in the seat.

4. The ceiling fan assembly of claim 3 wherein the mounting bracket comprises a collar supporting the seat and the collar has a side opening through which the first hanger ball is received.

5. The ceiling fan assembly of claim 1 wherein the first shaft comprises two pins extending from diametrically opposite portions of the first hanger ball.

6. The ceiling fan assembly of claim 1 wherein a plane can be defined by the first rotational axis and the second rotational axis of the dual axis gimble.

7. The ceiling fan assembly of claim 1 wherein the second shaft passes through the second end of the downrod to operably connect the downrod to the dual axis gimble.

8. The ceiling fan assembly of claim 1 wherein the second shaft passes through the second hanger ball.

9. The ceiling fan assembly of claim 8 wherein the second shaft has opposing ends extending externally of the second hanger ball, and the opposing ends are rotationally supported by corresponding supports in the first hanger ball.

10. The ceiling fan assembly of claim 1 wherein the mounting bracket includes supports in which opposing ends of the first shaft are rotationally supported.

11. The ceiling fan assembly of claim 1, further comprising a fixing bar coupled to the mounting bracket.

12. The ceiling fan assembly of claim 1, further comprising a canopy having a first plate and a second plate.

13. The ceiling fan assembly of claim 12, wherein the second plate couples to the mounting bracket, the first plate abuts a mounting surface, and a shell portion of the canopy couples the first plate and the second plate.

14. The ceiling fan assembly of claim 1 wherein the first shaft includes pins, nubs, or protrusions extending from the first hanging ball and received by supports in the mounting bracket.

15. A ceiling fan mount for connecting a ceiling fan to a surface comprising:

a downrod having first and second ends, with the first end configured to couple to the ceiling fan;

a mounting bracket configured to mount to the surface; and at least a dual axis gimble connecting the second end of the downrod to the mounting bracket, wherein the dual axis gimble comprises:

an outer hanger ball comprising a first shaft rotationally connecting the outer hanger ball to the mounting bracket to define a first rotational axis for the dual axis gimble; and an inner hanger ball, located within an interior of the outer hanger ball, the inner hanger ball comprising a second shaft rotationally connecting the inner hanger ball to the outer hanger ball, with the second shaft defining a second rotational axis.

16. The ceiling fan mount of claim 15 wherein the mounting bracket comprises a seat and the dual axis gimble is received in the seat.

17. The ceiling fan mount of claim 16, further comprising a fixing bar coupled to the mounting bracket.

18. The ceiling fan mount of claim 15 wherein the first shaft includes pins, nubs, or protrusions extending from the outer hanger ball and received by supports in the mounting bracket.

19. The ceiling fan mount of claim 15 wherein the second end of the downrod is mounted to the inner hanger ball.

20. The ceiling fan mount of claim 15 wherein a plane is defined by the first rotational axis and the second rotational axis of the dual axis gimble.

* * * * *